United States Patent [19]

Waynick

[11] Patent Number: 4,879,054

[45] Date of Patent: Nov. 7, 1989

[54] PROCESS FOR PRODUCING LOW TEMPERATURE HIGH PERFORMANCE GREASE

[75] Inventor: John A. Waynick, Bolingbrook, Ill.

[73] Assignee: Amoco Corporation, Chicago, Ill.

[21] Appl. No.: 162,045

[22] Filed: Feb. 29, 1988

[51] Int. Cl.[4] ..... C10M 111/02

[52] U.S. Cl. ..... 252/41; 252/56 S

[58] Field of Search ..... 252/41, 56 S

[56] References Cited

U.S. PATENT DOCUMENTS

| | | | |
|---|---|---|---|
| 2,470,965 | 5/1949 | Woods et al. | 252/42 |
| 2,491,054 | 12/1949 | Morway | 252/42 |
| 2,521,438 | 9/1950 | Zimmer et al. | 252/42 |
| 2,721,844 | 10/1955 | Culnane et al. | 252/42.1 |
| 2,750,341 | 6/1956 | Morway et al. | 252/42 |
| 2,953,528 | 9/1960 | O'Neil | 252/42 |
| 3,428,562 | 2/1969 | Crouch et al. | 252/42 |
| 3,860,522 | 1/1975 | Fischer et al. | 252/56 S |
| 4,749,502 | 6/1988 | Alexander et al. | 252/56 R |

*Primary Examiner*—William R. Dixon, Jr.
*Assistant Examiner*—Jerry D. Johnson
*Attorney, Agent, or Firm*—Thomas W. Tolpin; William H. Magidson; Ralph C. Medhurst

[57] ABSTRACT

A method is provided for manufacturing a grease that exhibits high performance qualities at extremely cold temperatures and moderately elevated temperatures, as well as under normal operating conditions. In the method, a lithium soap thickener is formed in, heated, and mixed with polyalphaolefin. Upon cooling, a diester oil is blended with the polyalphaolefin and lighium soap thickener. Subsequently, extreme pressure antiwear additives and oxidation and corrosion inhibitors are added to the grease. Special hydroxides can also be intermittently added to enhance the performance of the grease under extreme temperatures as well as to minimize oil bleeding and transesterification.

6 Claims, No Drawings

PROCESS FOR PRODUCING LOW TEMPERATURE HIGH PERFORMANCE GREASE

BACKGROUND OF THE INVENTION

This invention pertains to a process for producing greases and, more particularly to a method of manufacturing low temperature, high performance lithium soap grease.

Many mechanisms such as bearings, actuator screws, gauges, instruments, aircraft, vehicles, tanks, and other military equipment are required to perform well at very low temperatures, such as at −100° F. Lubricating greases for such mechanisms, therefore, must perform well at low temperatures. It is desirable that such lubricating greases have outstanding oxidation resistance, good extreme pressure (EP) antiwear properties, superior pliability, and excellent stability at normal, as well as very low, temperatures.

Conventional polyalphaolefin (PAO) greases are economical and have many fine qualities, but are usually not reliable nor do they perform well at low temperatures, such as well below −40° F., especially below −65° F.

Conventional mineral oil based greases are also limited in their usefulness in low temperature applications. For example, greases made from paraffinic mineral oil often provide below average performance at low temperatures because of wax which is usually present in the grease. At temperatures below 0° F., wax can crystallize out and render the grease hard and non-pliable. Dewaxing processes can reduce the wax level in paraffinic mineral oil but cannot eliminate it altogether. Naphthenic mineral oils have virtually no wax and have better low temperature flow properties, but do not give good flow properties at extremely low temperatures, such as −65° F. to 100° F. Also, naphthenic oils are more prone to oxidative and thermal degradation at high temperatures.

In the past two decades, diesters and other synthetic oils have been used as replacements of mineral oil in fluid lubricants and greases. Such diesters include dialkyl esters of dicarboxylic acids, such as di-2-ethyl hexyl azelate, di-isodecyl azelate, di-tridecyl azelate, di-isodecyl adipate, di-tridecyl adipate, and many others. Desirably, diesters have good low temperature flow properties and reasonably good resistance to oxidative breakdown. Unfortunately, however, diesters have very poor hydrolytic stability and will break down into two alcohol moieties and one dicarboxylic acid moiety when heated in the presence of water. The situation is made even worse when acidic or basic conditions are present since the hydrolytic breakdown of the diester is effectively catalyzed by acid or base. The above factors have traditionally made diesters a poor synthetic base oil choice for lithium soap thickened greases.

In lithium soap thickened greases, the metal base, usually lithium hydroxide or in its more commonly available form of lithium hydroxide monohydrate, is reacted with a fatty acid, usually 12-hydroxystearic acid, or with a fatty acid derivative, usually methyl 12-hydroxystearate or hydrogenated castor oil. This reaction is most often carried out in the base oil with water also being present. The water is added to act as a reaction solvent if the acid is used. If the fatty acid derivative is used, the water acts both as reaction solvent and reactant, the latter effect being necessary for the hydrolytic cleavage of the ester linkages in the methyl 12-hydroxystearate or the hydrogenated castor oil. When forming a grease thickener soap in a diester synthetic oil, the same conditions normally used to react the thickener components can cause hydrolytic breakdown of the diester. Resulting products can have little or no grease texture and such products are unsatisfactory as high performance lubricants.

Lithium 12-hydroxystearate greases have been successfully made in diester synthetic fluids. However, to do so requires extreme care in controlling the temperature/time profile during the formation of the thickener. The manufacturing procedure must maintain a delicate balance, forming the lithium 12-hydroxystearate without significantly hydrolyzing the diester oil. Correspondingly, such procedures are labor intensive and cumbersome. Even when successfully made, the resulting lithium greases will inevitably have some reaction products from unwanted hydrolytic breakdown of diester and subsequent neutralization of the formed dicarboxylic acid moieties by lithium hydroxide. An equivalent amount of unreacted 12-hydroxystearic acid will remain in the final grease after all the lithium hydroxide has reacted. This unwanted side reaction can cause a lower grease yield due to the considerably less thickening power of the dilithium salt of the dicarboxylic acid moiety of the diester. Yield of the lithium grease is also lowered since the grease cannot be heated to the melting point of lithium 12-hydroxystearate to improve certain properties of the grease without thermally degrading the grease. Melting and recrystallizing cannot be carried out in conventional lithium greases made in diester oils since an undesirable transesterification between free, unreacted 12-hydroxystearic acid and diester oil can occur at the required high temperature.

Another type of synthetic oil is polyol esters. Polyol esters have good oxidation and hydrolytic stability but are expensive, unreliable, and have mediocre performance.

Typifying some of the many types of prior art lubricating oils, greases, and additives, are those described in U.S. Pat. Nos. 3,622,512; 3,853,775; 3,876,550; lubricating oils, greases, and additives have met with varying degrees of success but generally do not perform well at low temperatures, especially at ultra low temperatures near −100° F.

It is, therefore, desirable to provide an improved lithium grease which performs well at these low temperatures.

SUMMARY OF THE INVENTION

An improved lithium thickened grease is provided which performs well at normal temperatures and ambient conditions as well as at extreme temperatures, including ultra low temperatures, such as at least −100° F., and moderately elevated temperatures, such as at least +250° F. The novel lithium thickened grease has outstanding oxidation resistance, good extreme pressure (EP) antiwear properties, superior pliability, enhanced pumpability, and excellent stability at the above temperature ranges.

Advantageously, the novel grease has excellent shear stability, low oil bleed, good water resistance, and excellent resistance to ferrous and copper corrosion. The grease is also reliable, consistent, safe, economical, effective, and easy to manufacture. The novel grease further provides exceptional performance qualities at low temperatures as well as at moderately elevated temperatures, which is particularly useful for bearings and other mechanisms, such as actuator screws, instruments, aircraft, vehicles, tanks, and other military equipment.

Desirably, the grease can be readily formulated and blended without elaborate procedures and temperature control devices which are often required for blending prior art lithium greases.

To this end, the novel grease comprises a synthetic oil blend, a lithium soap thickener, and a low temperature compatible additive package. The special synthetic oil blend comprises a synergistic combination of polyalphaolefin (PAO) and diester. The diester can comprise an aliphatic diester of an aliphatic dicarboxylic acid, or more specifically, a dialkyl ester of a dicarboxylic acid, such as di-2-ethyl hexyl azelate, di-isodecyl azelate, di-tridecyl azelate, di-isodecyl adipate, or di-tridecyl adipate.

The additive package preferably comprises a blend or mixture of compounds containing dithiocarbamates, phosphates, and hydroxides as well as corrosion and oxidation inhibitors and metal deactivators.

The novel grease composition comprises a synergistic combination of compounds, ingredients, or components, each of which alone is insufficient to give the desired properties, but when used in concert give the outstanding grease of this invention.

We have discovered that a lithium grease containing a mixture of PAO and diester (diester oil) can be made without the yield losses associated with prior art lithium greases made in all diester oil. This new lithium grease gives low temperature properties comparable to the lithium greases made in all diester oil.

In order to produce and manufacture the novel, high performance, low temperature grease, a thickener comprising lithium 12-hydroxystearate soap is formed by reacting 12-hydroxystearic acid, methyl 12-hydroxystearate, or hydrogenated castor oil with a lithium base, such as lithium hydroxide or lithium hydroxide monohydrate. The lithium soap thickener is formed in and mixed with PAO, preferably in the presence of water. Thereafter, the water and any alcoholic by-products of saponification are removed and then diester is added and mixed with the PAO and lithium soap thickener to form a generally homogeneous mixture. A sufficient amount of additives are added to the mixture to impart extreme pressure (EP) antiwear as well as other properties to the grease. Such additives can include substantially ashless dithiocarbamate and substantially ashless aryl phosphate, both of which are soluble in diester and PAO. Other additives can also be useful.

Preferably, this new grease is formed by first making a lithium 12-hydroxystearate grease concentrate in all PAO. Then the dried grease concentrate is cooled, such as to about +250° F. At this point diester oil can be added to the grease concentrate until the total synthetic oil composition is at the desired value or proportion, such as about 50% diester and about 50% PAO. Since the diester oil was not introduced into the grease until the temperature was about +250° F. or lower, transesterification is avoided. Because the diester was absent during the formation of thickener, hydrolytic cleavage of the diester is also avoided. By using this procedure, a lithium grease having all the advantages of both PAO and diester oil without any of the previously discussed disadvantages at low temperatures is obtained.

We further discovered that by adding calcium hydroxide and excess lithium hydroxide monohydrate to the finished base grease, the oil bleed properties were significantly reduced. Also, by adding the excess lithium hydroxide monohydrate at the beginning of the grease manufacturing procedure, along with the PAO and 12-hydroxystearic acid, before lithium 12-hydroxystearate soap is formed, we minimize and virtually eliminate unreacted 12-hydroxystearic acid in the dry base grease. Under these conditions, the base grease with or without added diester oil can be safely heated to the thickener melt point (+400° F.) without any substantial transesterification. By cooling the melt and recrystallizing the thickener, grease yield, shear stability, and oil bleed of the final product are further improved.

A more detailed explanation of the invention is provided in the following description and appended claims.

DETAILED DESCRIPTION OF THE PREFERRED EMBODIMENT

A low temperature high performance grease provides excellent performance qualities at both very low temperatures, such as at least −100° F., and moderately high temperatures, such as at least +250° F., as well as under normal conditions and mid-range temperatures therebetween. The low temperature high performance grease is also sometimes ferred form it has a pumpkin orange color. The grease comprises, by weight: from about 65% to about 93% of a synthetic base oil blend comprising a blend of synthetic oils as discussed below, from about 5% to about 20% of lithium 12-hydroxystearate soap thickener, and from about 2% to about 15% of an additive package comprising a blend of additives as discussed below for imparting extreme pressure (EP) antiwear properties to the grease as well as for inhibiting oxidation, oil separation (oil bleeding) in the grease, and corrosion of copper and iron.

Preferably, the pumpkin grease comprises, by weight: from about 71% to about 88% synthetic base oil blend, from about 8% to about 17% lithium 12-hydroxystearate soap thickener, and from about 4% to about 12% additives.

For best results at both low temperatures and moderately high temperatures, the pumpkin grease comprises, by weight: from about 75% to about 84% synthetic base oil blend, from about 10% to about 15% lithium 12-hydroxystearate soap thickener, and from about 6% to about 10% additives.

The synthetic base oil blend comprises by weight, based upon the total weight of the base oil blend: from about 25% to about 95%, preferably from about 30% to about 85%, and most preferably about 40% to about 60% diester (diester oil); and from about 5% to about 75%, preferably from about 15% to about 70%, and most preferably from about 40% to about 60% polyalphaolefin (PAO).

Diester oil has outstanding extreme low temperature flow properties and good resistance to oxidative breakdown. The diester oil can comprise an aliphatic diester of a dicarboxylic acid. For best results, the diester oil comprises a dialkyl aliphatic diester of an alkyl dicarboxylic acid, such as di-2-ethyl hexyl azelate, di-isodecyl adipate, or di-tridecyl adipate. Di-2-ethyl hexyl azelate is most preferred and is commercially available under the brand name Emery 2958 by Emery Chemicals.

Polyalphaolefin is a synthetic fluid. It is effective at high temperatures, such as occurs during operation of internal combustion engines of vehicles or during shooting (firing) of projectiles from tanks, cannons, and howitzers. It is also very effective at low temperatures such as occurs in arctic locations. It is not, however, nearly as effective in the absence of diester at ultra low temperatures such as −100° F., which can, for example, occur in high altitude aircraft. Polyalphaolefin provides superior oxidation and hydrolytic stability and high film strength. Polyalphaolefin also has a higher molecular weight, higher flash point, higher fire point, lower volatility, higher viscosity index, and lower pour point than mineral oil.

It was unexpectedly and surprisingly found that polyalphaolefin interacts with diester to provide advantageous low temperature mobility, pumpability, pliability, and lubricity.

Polyalphaolefin has a typical molecular structure as follows:

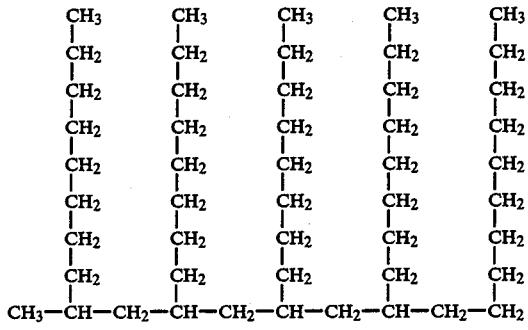

One particularly useful type of PAO is sold by Emery Chemicals under the brand name Emery 3004. Emery 3004 polyalphaolefin has a viscosity of 3.86 centistokes (cSt) at +212° F. (100° C.) and 16.75 cSt at +104° F. (40° C.). It has a viscosity index of 125 and a pour point of −98° F., It also has a flash point of +432° F. and a fire point of 478° F.

Gulf Synfluid 4 cSt PAO, commercially available from Gulf Oil Chemicals Company, a subsidiary of Chevron Corporation, is similar in many respects to Emery 3004. Mobil SHF-41 PAO, commercially available from Mobil Chemical Corporation, is also similar in many respects to Emery 3004.

Another useful type of PAO is sold by Emery Chemicals under the brand name of Emery 3006. Emery 3006 polyalphaolefin has a viscosity of 5.88 cSt at +212° F. and 31.22 cSt at +104° F. It has a viscosity index of 135 and a pour point of −87° F. It also has a flash point of 464° F. and a fire point of +514° F.

A further useful type of PAO is sold by Uniroyal, Inc. under the brand name SYNTON PAO-40. SYNTON PAO-40 polyalphaolefin has a viscosity of 188 SUS at 212° F. and 2131 SUS at 104° F. It has a viscosity index of 142 and a pour point of −55° F. It has a molecular weight of 1450, a flash point of +550° F., and a fire point of +605° F.

The additives comprise by weight, based upon the total cumulative weight of the additives: (a) from about 10% to about 50%, preferably about 20% to about 42%, and most preferably about 30% to about 40% substantially ashless dithiocarbamate comprising dithiocarbamate-containing compounds as explained below; (b) from about 10% to about 50%, preferably about 20% to about 42%, and most preferably about 30% to about 40% of a phosphate-containing compound as explained below; (c) from about 0.5% to about 6%, preferably from about 1% to about 5%, and most preferably from about 2% to about 4% excess hydroxide-containing compounds as explained below; (d) from about 3% to about 22%, preferably from about 6% to about 18%, and most preferably from about 8% to about 15% of iron corrosion inhibitors, also referred to as rust corrosion inhibiting agents and anticorrodants, as explained below; (e) from about 1% to about 12%, preferably from about 2% to about 10%, and most preferably about 4% to about 8% oxidation inhibitors or antioxidants as explained below; and (f) from about 0.2% to about 2%, preferably from about 0.6% to about 1.6%, and most preferably from about 0.8% to about 1.4% metal deactivators or metal passivators as explained below.

The dithiocarbamate-containing compounds can comprise one or more of the following compounds: alkylene bis dithiocarbamate, arylene bis dithiocarbamate, or alkyl arylene bis dithiocarbamate. For best results, the dithiocarbamate comprises a 4,4'-methylene bis dithiocarbamate (ashless dibutyldithiocarbamate), such as is commercially available under the brand name Vanlube 7723 by R. T. Vanderbilt Company, Inc. Dithiocarbamate-containing compounds provide extreme pressure (EP) antiwear properties.

The phosphate-containing compounds can comprise: alkyl phosphate, alkyl aryl phosphate, and/or preferably aryl phosphate. For best results, the phosphate-containing compounds comprise triaryl phosphate, such as sold under the brand name Durad 150 by FMC Corporation. Phosphate-containing compounds enhance the antiwear as well as the EP properties of the grease.

The hydroxide-containing compounds can comprise by weight, based on the total weight of the hydroxide-containing compounds: from about 10% to about 70%, preferably about 20% to about 60%, and most preferably about 30% to about 50% calcium hydroxide and from about 30% to about 90%, preferably about 40% to about 80%, and most preferably about 50% to about 70% lithium hydroxide monohydrate or a stoichiometric equivalent amount of lithium hydroxide. The above lithium hydroxide monohydrate is in excess of the stoichiometric amount required to react all of 12-hydroxystearic acid or methyl 12-hydroxystearate to form lithium 12-hydroxystearate soap thickener. The excess hydroxides interact with the lithium soap thickener and synthetic base oil blend to reduce the oil separation and bleed properties of the grease. The excess lithium hydroxide also permits the diester to be heated to at least the melting point of the lithium 12-hydroxystearate thickener without any substantial transesterification.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. The preferred corrosion (rust) inhibitor comprises alkaline earth metal alkyl sulfonate. Most preferably, for best results, the corrosion inhibitor comprises barium dinonyl napthalene sulfonate, such as sold under the brand name NaSul BSN by R. T. Vanderbilt Company, Inc.

Antioxidants or oxidation inhibitors prevent varnish and sludge formation in lubricating oils and oxidation of mineral oil in lubricating greases. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N-diphenyl-p-phenylenediamine, 2,2,4-trimethyldihydroquinoline oligomer, bis(4-isopropylaminophenyl)-ether, N-acyl-p-aminophenol, N-acylphenothiazines, N-ethylenediamine tetraacetic acid, and alkylphenol-formaldehyde-amine polycondensates.

Metal deactivators or metal passivators prevent undesirable interactions between lubricant and metal surfaces, diminish copper corrosion, and counteract the effects of metal on oxidation by forming catalytically inactive compounds with soluble or insoluble metal ions. The most common mechanisms by which such additives function involve either complexing the metal surface or forming a tenacious film on the surface. In either case, the metal surface is rendered unavailable for otherwise harmful catalytic or corrosive activity. The metal deactivators or passivators can comprise organic nitrogen and sulfur-containing compounds. Preferably, the metal deactivator or passivator comprises mercaptobenzothiazole or derivatives thereof. Most preferably, for best results, the metal deactivator or passivator comprises sulfur-free triazole derivatives, such as sold under the brand name Reomet 39 by Ciba-Geigy Company.

If desired, the additives can also include dyes or pigments to impart a desired color to the grease, supplemental oil separation inhibitors and tackiness agents, such as sold under the brand name Paratac by Paramins Chemical Company, a division of Exxon.

In order to produce and manufacture the low temperature, high performance grease, a lithium 12-hydroxystearate grease concentrate in polyalphaolefin (PAO) is first formed and mixed in a container, such as a kettle, pot, vessel, or tank. This can be accomplished by adding a 12-hydroxystearic compound, such as 12-hydroxystearic acid or methyl 12-hydroxystearate, to PAO and subsequently adding water and a chemically equivalent (stoichiometric amount) of lithium hydroxide monohydrate to react substantially with all of the 12-hydroxystearic compound. The 12-hydroxystearic compound, PAO, water, and lithium hydroxide monohydrate are heated to about +300° F. and simultaneously mixed (stirred) to form lithium 12-hydroxystearate soap thickener in PAO. The resultant mixture is dried while vaporizing and venting the volatile by-products of reaction. When 12-hydroxystearic acid is used, the volatile byproducts of reaction comprise water vapor (water of hydration and water of reaction). When methyl 12-hydroxystearate is used, the volatile byproducts of reaction comprise methyl alcohol and water vapor.

The dry base grease (lithium 12-hydroxystearate grease concentrate in PAO) is cooled to at least about 270° F., preferably to at least about +250° F. before the diester oil is added, blended, and mixed with the concentrate in PAO. This cooling step serves to substantially prevent transesterification of the diester. Hydrolytic cleavage of the diester is avoided by adding the diester after the lithium 12-hydroxystearate soap thickener is formed and the water removed. The base grease and diester mixture are cooled to a temperature ranging from about 200° F. to about +250° F., preferably before the remaining additives are added, mixed, and blended with the base grease and diester to produce the finished grease.

In order to enhance shear stability, as well as to improve (decrease) the oil separation and bleed properties of the grease, calcium hydroxide and excess lithium monohydrate are blended and admixed with the base grease. As used in this application, excess lithium hydroxide monohydrate means an amount of lithium hydroxide monohydrate in excess of the stoichiometric amount required to react all of the 12-hydroxystearate compound (12-hydroxystearic acid or methyl 12-hydroxystearate) to lithium 12-hydroxystearate soap thickener (concentrate).

In the preferred no melt process, the dried base grease (concentrate in PAO) is heated to a temperature of at least about +300° F., but below the melting point of about +400° F. of the lithium 12-hydroxystearate soap thickener. The calcium hydroxide and excess lithium hydroxide monohydrate are added, mixed and blended with the base with or before the admixing of the diester and/or other additives. Preferably, the excess lithium hydroxide monohydrate is added to the base grease above +220° F. to assure volatization of the water of hydration in order to remove that water from the grease.

In the most preferred melting process, the base grease (concentrate in PAO) is melted by heating the dried base grease to at least +400° F., preferably to a melting temperature ranging from about +400° F. to about +410° F. In the melting process, excess lithium hydroxide monohydrate is preferably added, blended, and mixed with the PAO and the 12-hydroxystearate compound at the very beginning of the thickener forming procedure, along with non-excess lithium hydroxide monohydrate, i.e., along with addition of the chemically equivalent, stoichiometric amount of lithium hydroxide monohydrate required to react all of the 12-hydroxystearate compound. This procedure minimizes transesterification. The calcium hydroxide is added to the base grease and diester mixture, along with the remaining other additives after the base grease and diester mixture is cooled to a temperature ranging from about 200° F. to about +250° F. The cooling step will also recrystallize the lithium 12-hydroxystearate soap thickener. The melting procedure provides even better grease yield, shear stability, and oil separation (oil bleed) properties than the no-melt (non-melting) procedure as discussed previously.

The following Examples in their entirety exemplify the technology previously described. The novel techniques and grease compositions in the Examples provide excellent performance at very low temperatures while also maintaining excellent performance at moderately elevated temperatures and normal temperatures, as well as provide low oil separation, resistance to ferrous and copper corrosion, shear stability, water resistance, oxidation stability, and other desirable high performance properties. The following Examples culminate in the grease of Example 30 which was submitted to and approved by the Department of the U.S. Navy, Department of Defense. The grease in Example 30 was evaluated and found to comply with all requirements of lubricating grease specification MIL-G-23827B, which is hereby incorporated by reference.

EXAMPLE 1

The following procedure was used for making 100 pounds of a lithium 12-hydroxystearate grease in all diester oil. The procedure was very tedious in order to minimize the unwanted hydrolysis of diester during the formation of thickener.

About 35.9 pounds of di-2-ethyl hexyl azelate (commercially available under the brand name of Emery Oil No. 2958 from Emery Chemicals) and 12.5 pounds of 12-hydroxystearic acid were placed (charged) in a 100 pound + capacity kettle. The mixture was heated with jacket steam and stirred (mixed) until the temperature reached +200° F. The temperature was held at +200° F. until all of the 12-hydroxystearic acid was melted and completely mixed into the Emery Oil. Then the jacket steam was shut off and cooling water was applied to the jacket. The kettle contents were cooled to +105° F. while the contents were stirred. When 105° F. was reached, 1.5 gallons of water were added to the kettle while continuing to stir and cool. When the temperature reached +80° F., 794.5 grams lithium hydroxide monohydrate were added to the kettle. Then the contents of the kettle were stirred and cooled for another 45 minutes. The kettle was closed and heated with 25 psi jacket steam until the kettle's internal pressure reached 20 psi. The kettle was then heated with 25 psi jacket steam for an additional hour. The kettle was further heated for another hour with 45–50 psi jacket steam. The steam was then turned off. The jacket was drained. The kettle was vented to relieve internal pressure. The kettle was opened and inspected to determine if the grease was dry. The grease was not yet dry and the kettle was closed and heated under vacuum to +180°–200° F. After one hour, the heat was turned off, the jacket drained, and the kettle vented. The kettle was opened and the grease was dry. The kettle was then closed and the dry grease in the kettle was heated to +300° F. while applying a vacuum. Upon reaching +300° F. the jacket steam was turned off and the grease was cooled with water in the jacket. When the grease was cooled to +240° F., the following additives were added: 227 grams phenyl alpha-naphthylamine (commercially available under the brand name Amoco 32 from Amoco Chemical Company), 1021.5 grams zinc dithiophosphate (commercially available under the brand name Amoco 196 from Amoco Chemical Company), 499.4 grams lead naphthenate, 45.4 grams calcium hydroxide, and 5.5 grams of colored dye for cosmetic or identification purposes, as well as an additional 46.7 pounds of di-2-ethyl hexyl azelate (commercially available under the brand name Emery Oil No. 2958 from Emery Chemicals). The grease was stirred, mixed, and cooled until the temperature reached +150° F. The grease was then milled in a colloid mill with a maximum gap clearance of 0.005 inches. The milled grease was cooled to +77° F. The final milled grease, once cooled to 77° F., had the following typical properties:

| | |
|---|---|
| Worked Penetration, ASTM D217 | 296 |
| Dropping Point, ASTM D2265 | 365° F. (185° C.) |
| Oil Separation FTM 321 (30 hr, 212° F.), % | 4.2 |
| Low Temperature Torque at −100° F. ASTM D1478 | |
| Starting Torque, N-m (newton-meter) | 0.6 |
| Running Torque, N-m (newton-meter) | 0.07 |

EXAMPLE 2

A lithium 12-hydroxystearate base grease using polyalphaolefin (PAO) was made. The PAO used is commercially available under the brand name Emery 3006 from Emery Chemicals. Emery 3006 has a kinematic viscosity of about 6 centistokes (cSt) at 100° C. The base grease was made in a laboratory grease kettle by the following procedure. About 15.93 pounds of PAO (Emery 3006) was placed (charged) in a kettle and heated to +180° F. while stirring. About 3.47 pounds of 12-hydroxystearic acid was added to the kettle and mixed (stirred) with the PAO at +180° F. until the mixture was melted. About 2,200 ml of water, 219.77 grams of lithium hydroxide monohydrate, and 66.89 grams of phenyl alpha-naphthylamine (commercially available under the brand name Amoco 32 from Amoco Chemical Company) were added to the kettle. The kettle was closed, continuously stirred and heated with jacket steam. Such heating sequentially occurred for: (a) 10 minutes with 12 psi jacket stream; (b) 10 minutes with 25 psi jacket steam; (c) 30 minutes with 50 psi jacket steam; and (d) 15 minutes with 100 psi jacket steam. The water vapor was then vented from the sealed kettle and the kettle opened. The base grease comprising the contents in the kettle were heated to about +400° F. with electric heating coils in the kettle walls until the thickener was melted. The base grease was stirred, mixed, and concurrently cooled to +240° F. using water in the jacket. About 13.88 grams calcium hydroxide was added to the kettle and the contents in the kettle were stirred for another 30 minutes. Thereafter, 2.46 pounds of PAO (Emery 3006) was added to the kettle and the contents in the kettle were mixed at a temperature ranging from +200° F. to +240° F. for 30 minutes. Then the base grease was removed from the kettle and stored. The base grease made by the above procedure had the following composition:

| Component | % (wt) |
|---|---|
| Emery 3006 (PAO) | 83.18 |
| Lithium 12-hydroxystearate | 16.00 |
| Phenyl alpha-naphthylamine | 0.67 |
| Calcium hydroxide | 0.13 |

EXAMPLES 3–5

Three samples were made from portions of the base grease of Example 2. In Example 3, 35.76 grams of PAO (commercially available under the brand name Emery 3006 from Emery Chemicals) was added to the base grease. In Example 4, 35.76 grams of polyol ester (commercially available under the brand name Mobil P-41 from Mobil Chemical Company) was added to the base grease. In Example 5, 43.5 grams of diester (commercially available under the brand name Emery 2958 from Emery Chemicals) was added to the base grease. To each sample was also added 1.92 grams lead naphthenate and 4.32 grams Amoco 196 (a zinc dithiophosphate) commercially available from Amoco Chemical Company. Each sample was thoroughly mixed and milled three times in a three roll mill to assure that a homogenous grease was formed. Final compositions and test properties are as follows:

| Example No. | 3 | 4 | 5 |
|---|---|---|---|

-continued

| | | | |
|---|---|---|---|
| Example No. 2 base grease, grams | 150.00 | 150.00 | 150.00 |
| Emery 3006 (PAO), grams | 35.76 | — | — |
| Emery 2958 (diester), grams | — | — | 43.50 |
| Mobil P-41 (polyol ester), grams | — | 35.76 | — |
| Lead Naphthenate, grams | 1.92 | 1.92 | 1.92 |
| Amoco 196 (zinc dithiophosphate), grams | 4.32 | 4.32 | 4.50 |
| Composition, % (wt) | | | |
| Emery 3006 (PAO) | 83.63 | 65.00 | 62.40 |
| Emery 2958 (diester) | — | — | 21.75 |
| Mobil P-41 (polyol ester) | — | 18.63 | — |
| Lithium 12-hydroxystearate | 12.50 | 12.50 | 12.00 |
| Lead Naphthenate | 1.00 | 1.00 | 1.00 |
| Amoco 196 (zinc dithiophosphate) | 2.25 | 2.25 | 2.25 |
| Phenyl alpha-naphthylamine | 0.52 | 0.52 | 0.50 |
| Calcium hydroxide | 0.10 | 0.10 | 0.10 |
| Test Data | | | |
| Low Temperature Torque at −100° F. ASTM D1478 | | | |
| Starting, N-m (newton-meter) | 1.7 | 1.8 | 0.90 |
| Running, N-m (newton-meter) | 0.25 | 0.23 | 0.087 |
| Oil Separation FTM 321 (30 hr, 212° F.), % | 5.1 | 4.7 | 6.7 |

Example 3, containing all PAO oil, and Example 4, containing a PAO+polyol ester blend, did not meet the desired low temperature torque requirement, i.e., a starting torque not greater than 1 newton-meter at −100° F. and a running torque not greater than 0.1 newton-meter at −100° F. By comparing Examples 3 and 4 with Example 1, it is seen that Emery 3006 (PAO) and Emery 3006+polyol ester blends are poorer synthetic oils for lithium 12-hydroxystearate greases at −100° F. than is Emery 2958 (diester) alone. Example 5, containing the PAO+diester blend, did meet the desired low temperature torque requirement. Example 4 met the desired requirement for oil separation, although by a very narrow margin.

EXAMPLE 6

Another lithium base was made in a manner similar to that given in Example 2. The only difference was that this base grease used Emery 3004, a polyalphaolefin (PAO}with a kinematic viscosity of about 4 cSt at 100° C. All other features of the grease composition and manufacturing procedure are identical to that of Example 2. The composition of the resulting grease is given below.

| Component | % (wt) |
|---|---|
| Emery 3004 (PAO) | 83.18 |
| Lithium 12-hydroxystearate | 16.00 |
| Phenyl alpha-naphthylamine | 0.67 |
| Calcium hydroxide | 0.13 |

EXAMPLES 7–9

Three samples were made from portions of the base grease of Example 6. In Example 7, 43.5 grams of Emery 3004 PAO were added to the base grease of Example 6. In Example 8, 43.5 grams of polyol ester were added to the base grease of Example 6. In Example 9, 43.5 grams of diester were added to the base grease of Example 6. To each sample were also added 2 grams lead naphthenate and 4.5 grams of Amoco 196. Each sample was thoroughly mixed and milled three times in a three roll mill to assure that a homogenous grease was formed. Final compositions and test properties are as follows:

| Example No. | 7 | 8 | 9 |
|---|---|---|---|
| Example No. 6 Base, grams | 150.00 | 150.00 | 150.00 |
| Emery 3004 (PAO), grams | 43.50 | — | — |
| Emery 2958 (diester), grams | — | — | 43.50 |
| Mobil P-41 (polyol ester), grams | — | 43.50 | — |
| Lead Naphthenate, grams | 2.00 | 2.00 | 2.00 |
| Amoco 196 (zinc dithiophosphate), grams | 4.50 | 4.50 | 4.50 |
| Composition, % (wt) | | | |
| Emery 3004 (PAO) | 84.15 | 62.39 | 62.39 |
| Emery 2958 (diester) | — | — | 21.76 |
| Mobil P-41 (polyol ester) | — | 21.76 | — |
| Lithium 12-hydroxystearate | 12.00 | 12.00 | 12.00 |
| Lead Naphthenate | 1.00 | 1.00 | 1.00 |
| Amoco 196 (zinc dithiophosphate) | 2.25 | 2.25 | 2.25 |
| Phenyl alpha-naphthylamine | 0.50 | 0.50 | 0.50 |
| Calcium hydroxide | 0.10 | 0.10 | 0.10 |
| Test Data | | | |
| Worked Penetration, ASTM D217 | 294 | 298 | — |
| Dropping Point, °F., ASTM D2265 | 384 | 371 | 366 |
| Low Temperature Torque at −100° F. ASTM D1478 | | | |
| Starting, N-m (newton-meter) | 1.2 | 1.2 | 0.64 |
| Running, N-m (newton-meter) | 0.14 | 0.11 | 0.069 |
| Oil Separation FTM 321 (30 hr, 212° F.), % | 4.8 | 4.5 | 5.1 |

The pattern of data for Examples 7–9 is similar to that obtained for Examples 3–5. The lighter 4 cSt Emery 3004 PAO of Examples 7–9 reduced all low temperature torque values compared to the corresponding greases of Examples 3–5. However, the all PAO grease and the PAO+polyol ester grease did not meet the desired low temperature torque requirements. Also, neither of these greases performed as well as the all diester grease of Example 1.

The PAO+diester grease of Example 9 easily met the desired low temperature torque requirements. A comparison of low temperature torque data for Examples 1 and 9 shows Example 9 to be surprisingly good. Although Example 9 has a base oil blend which is only 26% diester, it gave low temperature torque values comparable to Example 1 which has all diester base oil. This is unexpected and surprising since 74% of Example 9's base oil is Emery 3004 (PAO) which by itself had been previously known to be significantly inferior at −100° F.

Although Examples 8 and 9 met the desired oil separation requirement, it was only by a small margin. In routine commercial production, one could not depend on such formulations to always be under the desired 5.0% limit.

EXAMPLE 10

A lithium 12-hydroxystearate base grease was made in all polyol ester. The polyol ester used is commercially available under the brand name Mobil P-41 from Mobil Chemical Company. Mobil P-41 has a kinematic viscosity of about 3.5 cSt at 100° C. The base grease was made in a laboratory kettle using the following procedure. About 12.64 pounds of polyol ester (Mobil P-41) was placed (charged) in a kettle and heated to +180° F. while stirring. About 3.14 pounds of 12-hydroxystearic acid was added to the kettle and the contents of the kettle were mixed and stirred at +180° F. until all the 12-hydroxystearic acid in the kettle was melted and mixed into the polyol ester. About 1,500 ml of water, 198.87 grams of lithium hydroxide monohydrate, and 60.53 grams of phenyl alpha-naphthylamine (commercially available under the brand name Amoco 32 from Amoco Chemical Company) were added to the kettle. The kettle was closed. The contents in the kettle were concurrently stirred, mixed, and heated with jacket steam. Such heating sequentially occurred for: (a) 10 minutes with 12 psi jacket steam; (b) 10 minutes with 25 psi jacket steam; (c) 30 minutes with 50 psi jacket steam; and (d) 15 minutes with 100 psi jacket steam. The water vapor was vented from the sealed kettle and the kettle was opened. The base grease was heated to about +400° F. until the thickener was melted using electric heating coils in the kettle walls. The melted grease was then simultaneously stirred, mixed, and cooled to +240° F. using water in the jacket, while admixing 4 pounds of polyol ester (Mobil P-41) thereto. When the grease temperature cooled to +240° F., 12.11 grams of calcium hydroxide was added to the kettle. The contents of the kettle were then stirred (mixed) for another 45 minutes. The base grease comprising the contents in the kettle was removed and had the following properties.

| Component | % (wt) |
|---|---|
| Mobil P-41 (polyol ester) | 83.18 |
| Lithium 12-hydroxystearate | 16.00 |
| Phenyl alpha-naphthylamine | 0.67 |
| Calcium hydroxide | 0.13 |

EXAMPLES 11-12

In Example 11, polyol ester was added to a sample made from a portion of the base grease of Example 10. In Example 12, Emery 3004 PAO and polyol ester were admixed with a sample made from portions of the base greases of Examples 6 and Example 10. In each sample, lead naphthenate and Amoco 198 were also added. Each sample was thoroughly mixed and milled three times in a three roll mill to assure that a homogenous grease was formed. Final compositions and test properties are as follows:

| Example No. | 11 | 12 |
|---|---|---|
| Example No. 6 Base, grams | — | 90.00 |
| Example No. 10 Base, grams | 150.00 | 60.00 |
| Emery 3004 (PAO), grams | — | 26.10 |
| Mobil P-41 (polyol ester), grams | 43.50 | 17.40 |
| Lead Naphthenate, grams | 2.00 | 2.00 |
| Amoco 196 (zinc dithiophosphate), grams | 4.50 | 4.50 |
| Composition, % (wt) | | |
| Emery 3004 (PAO) | — | 50.49 |
| Mobil P-41 (polyol ester) | 84.15 | 33.66 |
| Lithium 12-hydroxystearate | 12.00 | 12.00 |
| Lead Naphthenate | 1.00 | 1.00 |
| Amoco 196 (zinc dithiophosphate) | 2.25 | 2.25 |
| Phenyl alpha-naphthylamine | 0.50 | 0.50 |
| Calcium hydroxide | 0.10 | 0.10 |
| Test Data | | |
| Worked Penetration, ASTM D217 | 311 | — |
| Dropping Point, °F., ASTM D2265 | 367 | — |
| Low Temperature Torque at −100° F. ASTM D1478 | | |
| Starting, N-m (newton-meter) | 1.7 | 1.2 |
| Running, N-m (newton-meter) | 0.030 | 0.072 |
| Oil Separation FTM 321 (30 hr, 212° F.), % | 4.2 | 3.7 |

Neither Example 11 nor Example 12 met the desired low temperature torque requirement for starting torque. Example 11, which has only polyol ester base oil, gave a disproportionally high starting torque when compared to its running torque. This was also true to a lesser extent with Example 12 which had a polyol ester PAO base oil blend. This indicates that the polyol ester (Mobil P-41) sets up an unworked structure at −100° F. which requires more force to break. After breakaway and initial working, the running torque drops to much lower levels than would have been predicted. The overall low temperature torque properties of Examples 11 and 12 are generally unsatisfactory. The oil separation of Examples 11 and 12 were somewhat improved over those of Examples 3-5 and Examples 7-9.

Examples 1-12 show that the PAO +diester blend gives low temperature torque performance at −100° F. which is comparable to that of diester alone. PAO, polyol ester, and PAO+polyol ester blends give inferior low temperature torque performance. Although these examples establish a surprisingly superior synthetic oil blend for lithium grease, they do not provide dependably acceptable oil separation properties. Also, the lead naphthenate-containing additive system may not be toxicologically acceptable by today's standards. A different, lead-free additive system is described and evaluated in Examples 13-18.

EXAMPLES 13-18

Six greases were made from portions of the base grease of Example 6. The lead naphthenate and Amoco 196 (zinc dithiophosphate) of previous examples were replaced with 4,4'-methylene bis(dibutyldithiocarbamate), commercially available under the brand name Vanlube 7723 by R. T. Vanderbilt Company, and triaryl phosphate, commercially available under the brand name Durad 150 by FMC Corporation. Rust inhibition was provided by 1% additions of barium dinonylnaphthylene sulfonate in PAO, commercially available under the brand name NaSul BSN(PAO) by King Industries. Each sample was mixed well and milled three times with a three roll mill to assure that a homogeneous grease was formed. Sample composition and test data are as follows:

| Example No. | 13 | 14 | 15 |
|---|---|---|---|
| Example No. 6 Base Grease | 100.00 | 100.00 | 100.00 |
| Emery 2958 (diester) | 25.34 | 26.67 | 24.00 |
| Vanlube 7723 | 5.33 | 5.33 | 5.33 |
| Durad 150 (triaryl phosphate) | 1.33 | — | 2.67 |
| NaSul BSN(PAO) (barium dinonyl naphthylene) | 1.33 | 1.33 | 1.33 |
| Composition, % (wt) | | | |
| Emery 3004 (PAO) | 62.39 | 62.39 | 62.39 |
| Emery 2958 (diester) | 19.01 | 20.01 | 18.01 |
| Lithium soap | 12.00 | 12.00 | 12.00 |
| Vanlube 7723 | 4.00 | 4.00 | 4.00 |
| Durad 150 (triaryl phosphate) | 1.00 | — | 2.00 |
| NaSul BSN(PAO) | 1.00 | 1.00 | 1.00 |
| Amoco 32 (phenyl alpha-naphthylamine) | 0.50 | 0.50 | 0.50 |
| Calcium hydroxide | 0.10 | 0.10 | 0.10 |
| Test Data | | | |
| Four Ball EP, LWI, ASTM D2596 | 31.5 | 28.4 | 30.3 |
| Low Temperature Torque at −100° F. ASTM D1478 | | | |
| Starting, N-m (newton-meter) | 1.4 | — | — |
| Running, N-m (newton-meter) | 0.087 | — | — |
| Copper Strip Corrosion ASTM D4048 | — | — | — |

| Example No. | 16 | 17 | 18 |
|---|---|---|---|
| Example No. 6 Base Grease | 100.00 | 100.00 | 100.00 |

-continued

| | | | |
|---|---|---|---|
| Emery 2958 (diester) | 22.66 | 24.00 | 24.00 |
| Vanlube 7723 | 6.67 | 4.00 | 2.67 |
| Durad 150 (triaryl phosphate) | 2.67 | 4.00 | 5.33 |
| NaSul BSN(PAO) (barium dinonylnaphthylene) | 1.33 | 1.33 | 1.33 |
| Composition, % (wt) | | | |
| Emery 3004 (PAO) | 62.39 | 62.39 | 62.39 |
| Emery 2958 (diester) | 17.01 | 18.01 | 18.01 |
| Lithium soap | 12.00 | 12.00 | 12.00 |
| Vanlube 7723 | 5.00 | 3.00 | 2.00 |
| Durad 150 (triaryl phosphate) | 2.00 | 3.00 | 4.00 |
| NaSul BSN(PAO) | 1.00 | 1.00 | 1.00 |
| Amoco 32 (phenyl alpha-naphthylamine) | 0.50 | 0.50 | 0.50 |
| Calcium hydroxide | 0.10 | 0.10 | 0.10 |
| Test Data | | | |
| Four Ball EP, LWI, ASTM D2596 | 32.3 | 35.2 | 25.4 |
| Low Temperature Torque at −100° F. ASTM D1478 | | | |
| Starting, N-m (newton-meter) | — | 1.0 | 1.1 |
| Running, N-m (newton-meter) | — | 0.078 | 0.058 |
| Copper Strip Corrosion ASTM D4048 | — | 3A | — |

Examples 13–18 show the effect of varying the relative concentrations of Vanlube 7723 and Durad 150. The Load Wear Index (LWI) response does not depend on the total level of both additives. Example 17, with 3% of each of Vanlube 7723 and Durad 150, gave disproportionally favorable results when compared to Examples 15, 16, and 18. This is especially surprising since Example 16 had more total Vanlube 7723 and Durad 150 than did Example 17. This allows for a reduction in total EP/antiwear additive level while increasing the LWI.

Examples 13 and 18 did not meet the desired requirements for −100° F. low temperature torque. This is not surprising since the relative amount of diester in their base oil blends is lower than previous samples such as Example 9: 23% diester versus 26%. Also, the additives used in Examples 13–18 are different than those used in all previous examples. Most of these additives are not pure but contain some diluent mineral oil. An additive can contain as much as 50% diluent oil. The types of diluent oils used by different additives can also be different. At −100° F., such differences can significantly change low temperature torques, especially the starting torque. Apparently, the additives used in Examples 13–18 are more detrimental to −100° F. starting torques. It has been found by the Applicant that this detrimental effect can be eliminated by increasing the proportion of diester in the synthetic oil blend. This fact is demonstrated in later examples below.

Example 17 Copper Strip Corrosion test results did not meet desired corrosion standards. This is probably due to the slightly active sulfur content of Vanlube 7723. Applicant has found that this can be corrected by a very small level of a metal deactivator, such as an oil soluble triazole derivative, as is commercially available under the brand name Reomet 39 by Ciba-Geigy.

EXAMPLE 19

A grease sample was made similar to Example 17 except that it also had 0.10% oil soluble triazole derivative, commercially available under the brand name Reomet 39 by Ciba-Geigy. Composition and test data are as follows:

| Example No. | 19 |
|---|---|
| Example No. 6 Base Grease | 100.00 |
| Emery 2958 (diester) | 23.87 |
| Vanlube 7723 [4,4'-methylene bis(dibutyl-dithiocarbamate)] | 4.00 |
| Durad 150 (triaryl phosphate) | 4.00 |
| NaSul BSN(PAO) | 1.33 |
| Reomet 39 (oil soluble triazole derivative) | 0.13 |
| Composition, % (wt) | |
| Emery 3004 (PAO) | 62.39 |
| Emery 2958 (diester) | 17.91 |
| Lithium soap | 12.00 |
| Vanlube 7723 | 3.00 |
| Durad 150 (triaryl phosphate) | 3.00 |
| NaSul BSN(PAO) | 1.00 |
| Amoco 32 (phenyl alpha-naphthylamine) | 0.50 |
| Calcium hydroxide | 0.10 |
| Reomet 39 (oil soluble triazole derivative) | 0.10 |
| Test Data | |
| Copper Strip Corrosion, ASTM D4048 | 1A |

Reomet 39 eliminated the copper corrosion problem which had been seen in Example 17.

EXAMPLE 20

To increase the proportion of diester in the synthetic oil blend requires a more concentrated lithium soap base grease in all PAO (polyalphaolefin). The previously used base of Example 6 was 16% thickener and allowed only 12% final thickener in the finished sample greases. The Emery 2958 (diester) added to that base and additives was only enough to bring its level to 23% of the total synthetic oil blend. By using a 20% thickened lithium soap grease in all PAO, more Emery 2958 (diester) would be required for a comparable final grease consistency.

A new lithium 12-hydroxystearate base grease in Emery 3004 (PAO) was made in a manner similar to that used for the base grease in Example 6. The calcium hydroxide which had been added to previous bases was not used this time. Before, 0.13% calcium hydroxide had been added to the 16% thickened base greases so as to mimic the composition of Example 1. Now that the benefits of a PAO+diester blend had been established by applicant in the prior Examples, the calcium hydroxide was no longer required nor added. The procedure by which this 20% thickener base grease was made is as follows. About 19.79 pounds of Emery 3004 (PAO) was added (charged) to the kettle and heated to 180° F. while stirring. About 4.90 pounds of 12-hydroxystearic acid was added to the kettle and stirred at +180° F. until it was melted and mixed into the Emery 3004 (PAO). About 1,500 ml of water, 310.73 grams of lithium hydroxide monohydrate, and 94.58 grams of phenyl alpha-naphthylamine (commercially available under the brand name of Amoco 32 by Amoco Chemical Company) were added to the kettle. The kettle was closed and its contents were concurrently stirred, mixed, and heated with jacket steam. Such heating sequentially occurred for: (a) 20 minutes with 25 psi jacket steam; (b) 30 minutes with 50 psi jacket steam; and (c) 30 minutes with 100 psi jacket steam. The water vapor was vented from the sealed kettle and the kettle was opened. The base grease was heated to about +400° F. until the thickener was melted by the electric heating coils in the kettle walls.

The contents comprising the base grease were continuously stirred in the kettle and cooled to +240° F. using water in the jacket. The resulting base grease was removed from the kettle and had the following composition.

| Component | % (wt) |
|---|---|
| Emery 3004 (PAO) | 79.17 |
| Lithium 12-hydroxystearate | 20.00 |
| Phenyl alpha-naphthylamine | 0.67 |

EXAMPLES 21–22

Two greases were made from portions of the base grease of Example 20. Each grease was mixed well and milled three times with a three roll mill to assure a homogenous grease was formed. Composition and test data for these greases are as follows:

| Example No. | 21 | 22 |
|---|---|---|
| Example No. 20 Base Grease, grams | 100.00 | 75.00 |
| Emery 2958 (diester), grams | 54.83 | 51.68 |
| Vanlube 7723, grams | 5.00 | 4.09 |
| Durad 150, grams (triaryl phosphate) | 5.00 | 4.09 |
| NaSul BSN(PAO) | 1.67 | 1.36 |
| Reomet 39 (oil soluble triazole derivative) | 0.17 | 0.14 |
| Composition, % (wt) | | |
| Emery 3004 (PAO) | 47.50 | 43.50 |
| Emery 2958 (diester) | 32.90 | 37.90 |
| Lithium 12-hydroxystearate | 12.00 | 11.00 |
| Vanlube 7723 | 3.00 | 3.00 |
| Durad 150 (triaryl phosphate) | 3.00 | 3.00 |
| NaSul BSN | 1.00 | 1.00 |
| Phenyl alpha-naphthylamine | 0.50 | 0.50 |
| Reomet 39 (oil soluble triazole derivative) | 0.10 | 0.10 |
| Test Data | | |
| Worked Penetration, ASTM D217 | 293 | — |
| Dropping Point, °F., ASTM D2265 | 384 | — |
| Four Ball EP, LWI, ASTM D2596 | 35.0 | — |
| Low Temperature Torque at −100° F., ASTM D1478 | | |
| Starting, N-m | 0.81 | 0.75 |
| Running, N-m | 0.058 | 0.052 |
| Emery 2958 (diester)/% Total Oil | 41 | 47 |
| High Temperature Bearing, ASTM D3336 Performance at 250° F. (121° C.), Hours to Failure | 2029+ | — |

The samples of Examples 21 and 22 met the desired requirements for −100° F. torque. The sample of Example 22, which had the highest proportion of diester in total oil, gave the better result. The sample of Example 21 gave exceptional results on the high temperature bearing performance test. The test was terminated after over 2000 hours without any sign of failure. The bearing was in excellent condition and the grease was still smooth and creamy in texture. Other properties measured were acceptable.

All previous Examples of finished greases were made from lithium 12-hydroxystearate bases in all PAO. All these bases had been melted at about +400° F. and then cooled to recrystallize the thickener.

EXAMPLE 23

The following example was made using a base which was not melted, but instead was heated no higher than +300° F. A lithium 12-hydroxystearate grease was made by the following procedure. About 15.21 pounds of polyalphaolefin (commercially available under the brand name of Gulf 4 cSt PAO by Gulf Oil Chemicals Company, a subsidiary of Chevron Corporation) was added (charged) to the kettle and heated to 180° F. while stirring. About 4.51 pounds of 12-hydroxystearic acid was added to the kettle and stirred at 180° F. until it was melted and mixed into the Gulf 4 cSt PAO. About 600 ml of water, 285.87 grams of lithium hydroxide monohydrate, and 87.02 grams of phenyl alpha-naphthylamine (Amoco 32) were added to the kettle. The kettle was closed. The contents in the kettle were continuously stirred, mixed, and heated with jacket steam. Such heating sequentially occurred for: (a) 10 minutes with 25 psi jacket steam; (b) 30 minutes with 75 psi jacket steam; and (c) 60 minutes with 100 psi jacket steam. The water vapor from the sealed kettle was vented and the kettle was opened. The kettle was then heated with 100 psi jacket steam for one hour while stirring its contents. The temperature of the grease reached about +300° F. The steam was turned off. The jacket was drained. The kettle was cooled with water through the jacket. When the temperature reached +200° F., about 5.56 pounds of Emery 2958 (diester) was slowly added to the kettle and the kettle's contents were stirred for 15 minutes. About 13 pounds of grease in the kettle were then removed for later use. To the remaining grease were admixed Vanlube 7723 [4,4'-methylene bis (dibutyldithiocarbamate)], Durad 150 (triaryl phosphate), NaSul BSN(PAO), Reomet 39 (oil soluble triazole derivative), and orange dye. The grease was blended (cut back) with Emery 2958 (diester) and Gulf 4 cSt PAO to make the % level of both PAO and diester substantially equal to each other while bringing the % level of thickener equal to 11.5%. The final grease was cooled to +150° F. and given three passes through a colloid mill at 0.0005 inches gap setting. The resultant grease composition and test data are as follows:

| | |
|---|---|
| Composition, % (wt) | |
| Gulf 4 cSt PAO (polyalphaolefin) | 40.45 |
| Emery 2958 (diester) | 40.44 |
| Thickener (lithium 12-hydroxystearate) | 11.50 |
| Vanlube 7723 | 3.00 |
| Durad 150 (triaryl phosphate) | 3.00 |
| NaSul BSN(PAO) | 1.00 |
| Amoco 32 (phenyl alpha-naphthylamine) | 0.50 |
| Reomet 39 (oil soluble triazole derivative) | 0.10 |
| Orange Dye | 0.01 |
| Test Data | |
| Worked Penetration, ASTM D217 | 285 |
| Dropping Point, ASTM 2265 | 377° F. (192° C.) |
| Oil Separation, FTM 321 (30 hr, 212° F.), % | 4.7 |
| Shear Stability, FTM 791-313 | 330 |
| Copper Strip Corrosion, ASTM D4048 | 1A |
| Four Ball EP, LWI, ASTM D2596 | 32.7 |
| Low Temperature Torque at −100° F., ASTM D1478 | |
| Starting, N-m (newton-meter) | 0.59 |
| Running, N-m (newton-meter) | 0.067 |
| High Temperature Bearing, ASTM D3336 Performance at 250° F. (121° C.), Hours To Failure | 1684+ |

Good results were obtained in all tests except oil separation which was only marginally acceptable. This is consistent with earlier Examples. High temperature bearing performance test results were similar to those of Example 21. The test was terminated without any signs of failure and the bearing and grease were in excellent condition.

EXAMPLES 24–27

To reduce oil separation in greases similar to Example 23, numerous methods were tried. Each of the four samples of Examples 24–27 was made by adding small amounts of other materials as indicated below to portions of the Example 23 grease. The other materials were lithium hydroxide monohydrate, calcium hydroxide, and Paratac (a high molecular weight polyisobutylene tackifier) by Paramins Chemical Company, a division of Exxon. After these additions were made, each sample was thoroughly mixed and milled three times in a three roll mill to assure that a homogeneous grease was formed. Compositions and test results are as follows:

| Example No. | 24 | 25 | 26 | 27 |
|---|---|---|---|---|
| Composition, % (wt) | | | | |
| Example 23 | 100.00 | 100.00 | 100.00 | 100.00 |
| Lithium hydroxide monohydrate | — | 0.20 | 0.20 | — |
| Calcium hydroxide | 0.10 | — | 0.10 | — |
| Paratac (polyisobutylene) | — | — | — | 4.00 |
| Test Results | | | | |
| Oil Separation (30 hr, 212° F.), % FTM 321 | 4.3 | 3.8 | 3.5 | 2.8 |

Comparing Examples 24–27 with Example 23, both lithium hydroxide and calcium hydroxide suppress oil separation and the combination of them both gives even better results. Paratac gave the best results but required a level 13 times higher than the combination of lithium hydroxide and calcium hydroxide. This difference is further magnified by Paratac's much greater cost per pound. Also, Paratac imparts a sticky, adhesive property which could be undesirable at −100° F. The method chosen as the best way to reduce oil separation of greases similar to Example 23 was found to be the addition of 0.20% excess lithium hydroxide monohydrate and 0.10% excess calcium hydroxide.

EXAMPLE 28

Another batch similar to Example 23 was made. The only difference was that enough excess lithium hydroxide monohydrate was added at the beginning so that the excess, unreacted lithium hydroxide in a final 12% thickened grease would be 0.20%, based on the monohydrate. Also, when the additives were added in, calcium hydroxide was also added to assist in reducing oil separation in the final product. All other aspects of preparing this grease were similar to Example 23. Composition and test data are as follows:

| | |
|---|---|
| Composition, % (wt) | |
| Gulf 4 cSt PAO (polyalphaolefin) | 40.05 |
| Emery 2958 (diester) | 40.04 |
| Thickener (lithium 12-hydroxystearate) | 12.00 |
| Vanlube 7723 | 3.00 |
| Durad 150 (triaryl phosphate) | 3.00 |
| NaSul BSN(PAO) | 1.00 |
| Amoco 32 (phenyl alpha-naphthylamine) | 0.50 |
| Excess LiOH monohydrate | 0.20 |
| Excess calcium hydroxide | 0.10 |
| Reomet 39 (oil soluble triazole derivative) | 0.10 |
| Orange Dye | 0.01 |
| Test Data | |
| Worked Penetration, ASTM D217 | 289 |
| Dropping Point, ASTM 2265 | 378° F. (192° C.) |
| Oil Separation, FTM 321 (30 hr, 212° F.), % | 3.4 |
| Shear Stability, FTM 791-313 | 335 |
| Copper Strip Corrosion, ASTM D4048 | 1A |
| Four Ball EP, LWI, ASTM D2596 | 30.0 |
| Water Washout at 100° F., % Loss, ASTM D1264 | 3.0 |
| Oxidation Resistance at 210° F., ASTM D942 | |
| Pressure change, KPa (Kilopascals) | |

-continued

| | |
|---|---|
| After 100 hours | 7.0 |
| After 500 hours | 17.5 |
| Low Temperature Torque at −100° F., ASTM D1478 | |
| Starting, N-m (newton-meter) | 0.59 |
| Running, N-m (newton-meter) | 0.043 |

EXAMPLE 29

Since excess lithium hydroxide is desired to minimize oil separation it can be added with the remaining lithium hydroxide when the lithium soap thickener is formed. This assures that substantially no unreacted 12-hydroxystearate is left in the dry base grease. Because of the absence of unreacted 12-hydroxystearic acid in the all PAO base grease, this grease can be heated to melt the thickener in the presence of added diester without significant transesterification occurring.

To determine the effect of such a procedure, a grease similar to Example 28 was made. Since the grease was heated to about +400° F., the excess lithium hydroxide is present in anhydrous form in the final grease. The dry base grease in all PAO was not cooled to +200° F. before adding diester. Instead, diester was added to make the heavy base grease easier to stir and the PAO+diester base grease was heated to about +400° F., until the thickener was melted. The grease was cooled to +200° F. to recrystallize the thickener and more Emery 2958 (diester) was added until the level of both PAO and diester were about equal. Then the Vanlube 7723, [4,4'-methylene bis (dibutyldithiocarbamate)], Durad 150 (triaryl phosphate), NaSul BSN(PAO), Reomet 39 (oil soluble triazole derivative), and orange dye were added and the grease was milled in a manner similar to Example 23. All other aspects of preparing this grease were similar to Example 28. The composition and test data are as follows:

| | |
|---|---|
| Composition, % (wt) | |
| Gulf 4 cSt PAO (polyalphaolefin) | 40.05 |
| Emery 2958 (diester) | 40.04 |
| Thickener (lithium 12-hydroxystearate) | 12.00 |
| Vanlube 7723 | 3.00 |
| Durad 150 (triaryl phosphate) | 3.00 |
| NaSul BSN(PAO) | 1.00 |
| Amoco 32 (phenyl alpha-naphthylamine) | 0.50 |
| Excess LiOH monohydrate | 0.20 |
| Excess calcium hydroxide | 0.10 |
| Reomet 39 (oil soluble triazole derivative) | 0.10 |
| Orange Dye | 0.01 |
| Test Data | |
| Unworked Penetration, ASTM D217 | 286 |
| Worked Penetration, ASTM D217 | 282 |
| Dropping Point, ASTM D2265 | 360° F. (182° C.) |
| Oil Separation, FTM 321 (30 hr, 212° F.), % | 1.8 |
| Shear Stability, FTM 791-313 | 285 |
| Copper Strip Corrosion, ASTM D4048 | 1A |
| Four Ball EP, LWI, ASTM D2596 | 37.0 |

Significant improvements over Examples 23 and 28 were achieved in shear stability and oil separation by using the excess lithium hydroxide and calcium hydroxide and recrystallizing the thickener from the melt.

EXAMPLE 30

Another sample similar to Example 28 was made. The procedure followed was similar to Example 28 except that Emery 3004 (PAO) was used as the 4 cSt PAO instead of the Gulf 4 cSt PAO. Composition and test data are as follows:

| Composition, % (wt) | |
|---|---|
| Emery 3004 (polyalphaolefin) | 40.09 |
| Emery 2958 (diester) | 40.00 |
| Thickener (lithium 12-hydroxystearate) | 11.77 |
| Vanlube 7723 | 3.00 |
| Durad 150 (triaryl phosphate) | 3.00 |
| NaSul BSN(PAO) | 1 00 |
| Amoco 32 (phenyl alpha-naphthylamine) | 0.50 |
| Excess LiOH monohydrate | 0.20 |
| Excess calcium hydroxide | 0.10 |
| Reomet 39 (oil soluble triazole derivative) | 0.10 |
| Orange Dye | 0.01 |
| Test Data | |
| Worked Penetration, ASTM D217 | 287 |
| Dropping Point, °F. (°C.) | 376° F. (191° C.) |
| Oil Separation, FTM 321 (30 hr, 212° F.), % | 2.1 |
| Shear Stability, FTM 791-313 | 285 |
| Copper Strip Corrosion, ASTM D4048 | 1A |
| Four Ball EP, LWI, ASTM D2596 | 35.0 |
| Corrosion Prevention (Rust), ASTM D1743 | Pass 1 |
| Four Ball Wear, ASTM D2266 (40 Kg, 1200 rpm, 75° C., 1 hr.), mm | 0.42 |

The test data of the sample of Example 30 met the desired performance levels. In particular, the grease of Example 30 has been approved by the U.S. Navy, Department of Defense, as fully meeting the specification and performance requirements of Military Specification MIL-G-23827B which is hereby incorporated by reference.

Among the many advantages of the novel grease and process are:

1. Outstanding performance at extremely low temperature, such as at −100° F.
2. Excellent performance at moderately elevated temperatures, such as +250° F.
3. Superior performance at normal temperatures and ambient conditions.
4. Good extreme pressure (EP) antiwear properties.
5. Better pliability, especially at extremely low temperatures, such as −100° F.
6. Enhanced pumpability.
7. Improved shear stability.
8. Excellent resistance to ferrous and copper corrosion.
9. Low oil bleed.
10. Less cumbersome to manufacture.
11. Easier to produce with consistent product quality.
12. Economical.
13. Dependable.
14. Safe.
15. Efficient.
16. Effective.

Although embodiments of this invention have been shown and described, it is to be understood that various modifications and substitutions, as well as rearrangement and combination of procedures and process steps, can be made by those skilled in the art without departing from the novel spirit and scope of this invention.

What is claimed is:

1. A process for producing grease, comprising the steps of:

forming lithium 12-hydroxystearate grease concentrate in polyalphaolefin in the absence of mineral oil by adding a 12-hydroxystearic compound to polyalphaolefin, said I2-hydroxystearic compound being selected from the group consisting of 12-hydroxystearic acid or methyl 12-hydroxystearate, subsequently adding at least a chemically equivalent amount of lithium hydroxide monohydrate to said 12-hydroxystearic compound and said polyalphaolefin, reacting substantially all of said 12-hydroxystearic compound with said lithium hydroxide monohydrate in said polyalphaolefin, in the presence of water, while concurrently mixing and heating said polyalphaolefin, 12-hydroxystearic compound, and lithium hydroxide monohydrate to a temperature ranging above about +180° F. to less than +400° F. to provide lithium 12-hydroxystearate soap thickener in said polyalphaolefin thereby providing lithium 12-hydroxystearate grease concentrate in polyalphaolefin;

substantially drying said lithium 12-hydroxystearate grease concentrate in polyalphaolefin by vaporizing and removing volatile by-products of reaction, said volatile by-products of reaction selected from the group consisting of water, methyl alcohol, and combinations thereof;

cooling said dried lithium 12-hydroxystearate grease concentrate in polyalphaolefin to a temperature at least about +270° F. to substantially minimize transesterification; thereafter blending an aliphatic diester of an aliphatic dicarboxylic acid with said 12-hydroxystearate grease concentrate in polyalphaolefin, said aliphatic diester of said aliphatic dicarboxylic acid comprising at least one member selected from the group consisting of di-2-ethyl hexyl azelate, di-isodecyl azelate, di-tridecyl azelate, di-isodecyl adipate, and di-tridecyl adipate;

said aliphatic diester being blended with said grease concentrate in said polyalphaolefin after said volatile by-products of reaction have been vented to substantially prevent hydrolytic cleavage of said aliphatic diester;

cooling said blend of aliphatic diester and said 12-hydroxystearate grease concentrate in polyalphaolefin to a temperature ranging from about +200° F. to about 250° F.; and thereafter admixing additives with said blend of diester and grease concentrate in polyalphaolefin to substantially impart extreme pressure antiwear properties to the grease and substantially inhibit corrosion of copper and iron, said additives comprising at least one dithiocarbamate-containing compound, a phosphate-containing compound, a corrosion inhibitor, an oxidation inhibitor, and a metal deactivator; and said blend of aliphatic diester, lithium 12-hydroxystearate grease concentrate in polyalphaolefin with said additives forming a grease with enhanced extreme temperature performance and lubricity qualities at temperatures as low as at least about −100° F. and as high as at least about +250° F.

2. A process for producing grease in accordance with claim 1 including adding calcium hydroxide and an amount of lithium hydroxide monohydrate in excess of the stoichiometric amount required to react all of said 12-hydroxystearic compound to said grease concentrate at a temperature above +220° F. to substantially minimize oil separation of said grease.

3. A process for producing grease, comprising the steps of:

forming lithium 12-hydroxystearate grease concentrate in polyalphaolefin by adding a 12-hydroxystearic compound to polyalphaolefin, said 12-hydroxystearic compound being selected from the group consisting of 12-hydroxystearic acid or methyl 12-hydroxystearate, subsequently adding at least a chemically equivalent amount of lithium hydroxide monohydrate to said 12-hydroxystearic compound and said polyalphaolefin, currently reacting substantially all of said 12-hydroxystearic compound with said lithium hydroxide monohydrate in said polyalphaolefin in the presence of water, while substantially minimizing transesterification by adding additional lithium hydroxide monohydrate to 12-hydroxystearic compound and said polyalphaolefin in excess of the stoichimetric amount required to react all of said 12-hydroxystearic compound;

concurrently stirring and heating said polyalphaolefin, 12-hydroxystearic compound, and lithium hydroxide monohydrate to a temperature ranging above about 180° F. to less than +400° F. to provide lithium 12-hydroxystearate soap thickener in said polyalphaolefin thereby providing lithium 12-hydroxystearate grease concentrate in said polyalphaolefin;

substantially drying said lithium 12-hydroxystearate grease concentrate in polyalphaolefin and removing volatile by-products of reaction, said volatile by-products of reaction selected from the group consisting of water, methyl alcohol, and combinations thereof;

heating said dried lithium 12-hydroxystearate thickener to a melting temperature above about +400° F. to substantially melt said dried thickener;

blending an aliphatic diester of an aliphatic dicarboxylic acid with said 12-hydroxystearate grease concentrate in polyalphaolefin, said aliphatic diester of said aliphatic dicarboxylic acid comprising at least one member selected from the group consisting of a di-2-ethyl hexyl azelate, di-isodecyl azelate, di-tridecyl azelate, di-isodecyl adipate, and di-tridecyl adipate, said aliphatic diester being blended with said grease concentrate in said polyalphaolefin after said volatile by-products of reaction have been removed to substantially prevent hydrolytic cleavage of said aliphatic diester;

crystallizing said melted thickener by substantially cooling said grease concentrate in polyalphaolefin to a temperature ranging from about +200° F. to about +250° F.; and thereafter mixing additives with said blend of diester and grease concentrate in polyalphaolefin to substantially impart extreme pressure antiwear properties to the grease and substantially inhibit corrosion of copper and iron, said additives comprising calcium hydroxide, at least one dithiocarbamate-containing compound, a phosphate-containing compound, a corrosion inhibitor, an oxidation inhibitor, and a metal deactivator; and said blend of aliphatic diester, lithium 12-hydroxystearate grease concentrate in polyalphaolefin with said additives being effective to provide a grease with enhanced extreme temperature performance and lubricity qualities at temperatures as low as at least about −100° F. and as high as at least about +250° F.

4. A process for producing grease in accordance with claim 3 wherein said cooling and said crystallizing occur before said blending of said aliphatic diester of an aliphatic dicarboxylic acid with said 12-hydroxystearate grease concentrate in polyalphaolefin.

5. A process for producing grease in accordance with claim 3 wherein:

the proportion of said diester blended with said polyalphaolefin is about 40% to about 60% diester and about 40% to about 60% polyalphaolefin;

said dithiocarbamate-containing compound comprises 4,4,-methylene bis dithiocarbamate;

said phosphate-containing compound comprises triaryl phosphate; and said corrosion inhibitor comprises barium diononyl naphthalene sulfonate.

6. A process for producing grease in accordance with claim 5 wherein:

said lithium 12-hydroxystearate thickener comprises from about 10% to about 15% by weight of said grease;

said additives collectively comprise from about 6% to about 10% of said grease; and said polyalphaolefin and said diester collectively comprise from about 75% to about 84% of said grease.

* * * * *

UNITED STATES PATENT AND TRADEMARK OFFICE

CERTIFICATE OF CORRECTION

PATENT NO. : 4,879,054

DATED : November 7, 1989

INVENTOR(S) : John A. Waynick

It is certified that error appears in the above-identified patent and that said Letters Patent is hereby corrected as shown below: On the Title page Abstract, line 7, "lighium" should read --lithium--.

Col. 4, line 29, "sometimes ferred form" should read --sometimes referred to as pumpkin grease because in the preferred form--.

Col. 11, line 42 "PAO$" should read --(PAO)--

Col. 14, line 1, "ester PAO" should read --ester + PAO--.

Col. 21, line 68, "12-" should read --12--.

Signed and Sealed this

Twenty-sixth Day of January, 1993

*Attest:*

STEPHEN G. KUNIN

*Attesting Officer*

*Acting Commissioner of Patents and Trademarks*